United States Patent [19]

Bottger

[11] 4,170,391

[45] Oct. 9, 1979

[54] REFRIGERATOR CABINET CONSTRUCTION

[75] Inventor: Bernard J. Bottger, Louisville, Ky.

[73] Assignee: General Electric Company, Louisville, Ky.

[21] Appl. No.: 945,678

[22] Filed: Sep. 21, 1978

[51] Int. Cl.[2] ..... F25D 11/00; E06B 3/70

[52] U.S. Cl. ..... 312/214; 248/221.3; 52/455

[58] Field of Search ..... 312/214; 248/73, 221.3, 248/223.1; 16/137; 52/455

[56] References Cited

U.S. PATENT DOCUMENTS

| | | | |
|---|---|---|---|
| 1,707,282 | 4/1929 | Schneider | 52/455 |
| 2,708,088 | 5/1955 | Steinke | 248/223.1 |
| 2,746,828 | 5/1956 | Amore | 312/214 |
| 3,134,132 | 5/1964 | Graber | 248/221.3 |
| 3,156,282 | 11/1964 | Bedford, Jr. | 248/223.1 |
| 3,284,976 | 11/1966 | Kadish | 52/455 |
| 3,674,359 | 7/1972 | Crowe | 312/214 |
| 3,834,779 | 9/1974 | Turner et al. | 312/214 |
| 3,868,152 | 2/1975 | Dixon | 312/214 |
| 4,013,371 | 3/1977 | Nagase | 52/455 |

*Primary Examiner*—Victor N. Sakran
*Attorney, Agent, or Firm*—Frederick P. Weidner; Radford M. Reams

[57] ABSTRACT

A support arrangement in a refrigerator having a hinged door to attach a hinge pin assembly to the cabinet outer case and to secure the outer case to a mullion. The outer case has a U-shaped portion, one leg of which has two spaced openings to receive fastener elements and the other leg has a slot located between the openings. The mullion has an edge abutting the edge of the outer U-shaped portion and also has an opening to receive a fastener element. A cross piece support member spans the abutment area and is inserted in the U-shaped portion. A first end of the cross piece support member has two openings to receive fastener elements and these openings are in alignment with the two spaced openings in the U-shaped portion. The first end also has a detent tang dimensioned and located to snap into the slot in the U-shaped portion to thereby retain the cross piece support member in its proper position relative to the fastener element openings. The second or opposite end of the cross piece support member has an opening to receive a fastener element which is in alignment with an opening in the mullion and there is a fastener element through both openings to secure the cross piece support member to the mullion. A hinge pin assembly abuts the outer case and fastener elements secure the hinge pin assembly, the case, and the cross piece support member together by passing through the openings in the U-shaped portion of the case and into the openings of the first end of the cross piece support member.

8 Claims, 5 Drawing Figures

REFRIGERATOR CABINET CONSTRUCTION

BACKGROUND OF THE INVENTION

In the construction of a household refrigerator, it is often desirable to provide a partition within the refrigerator for separating the refrigerator into first and second compartments such as a freezer compartment and a fresh food compartment, for example. It is further desirable to have the partition constructed in such a manner that there be a mullion across the front of the partition and secured to the cabinet outer case to afford a pleasing appearance. The freezer and fresh food compartments are in many cases closed by separate access doors which are hingedly attached to the cabinet outer case. To accomplish hingedly attaching the doors to the cabinet, there is a hinge pin assembly that must be secured to the cabinet in a manner that will provide sufficient strength to carry the doors and provide reliable operation of opening and closing the doors over a long period of time.

By my invention there is provided a support arrangement in the construction of a household refrigerator having hinged doors wherein the mullion is secured to the cabinet case and the hinge pin assembly is secured to the cabinet case by utilizing a cross piece support member that together with fastener elements provides a unitary structure.

SUMMARY OF THE INVENTION

There is provided a support arrangement in a refrigerator having a hinged door to attach a hinge pin assembly to the cabinet outer case and to secure the outer case to a mullion. The outer case has a U-shaped portion with an outer leg and an inner leg spaced from each other and having a center portion joining the two legs. The outer leg has two spaced openings to receive fastener elements and the inner leg has a slot located between the outer leg openings. The mullion has an edge abutting the edge of the outer leg of the U-shaped case portion and also has an opening to receive a fastener element. A cross piece support member spans an area where the mullion and outer case abut each other and is inserted in the U-shaped portion of the outer case. The cross piece support member has a first end and second end connected by a central portion. The first end has two spaced openings to receive fastener elements and these openings are in alignment with the two spaced openings in the outer leg. The first end also has a detent tang dimensioned and located to snap into the slot in the inner leg to thereby retain the cross piece support member in its proper position in the U-shaped portion of the outer case relative to the fastener element openings. The second end of the cross piece support member has an opening to receive a fastener element which is in alignment with the mullion opening. A fastener element through both openings secures the cross piece support member to the mullion. There is provided a hinge pin assembly abutting the outer case and fastener elements secure the hinge pin assembly, the case and the cross piece support member together by passing through the two openings in the outer leg of the case and into the openings of the first end of the cross piece support member.

By this support arrangement the mullion is secured to the outer case, the hinge pin assembly is secured to the outer case and all are interconnected by means of a cross piece support member and three fastener elements.

DESCRIPTION OF THE PREFERRED EMBODIMENT

Figure 1:
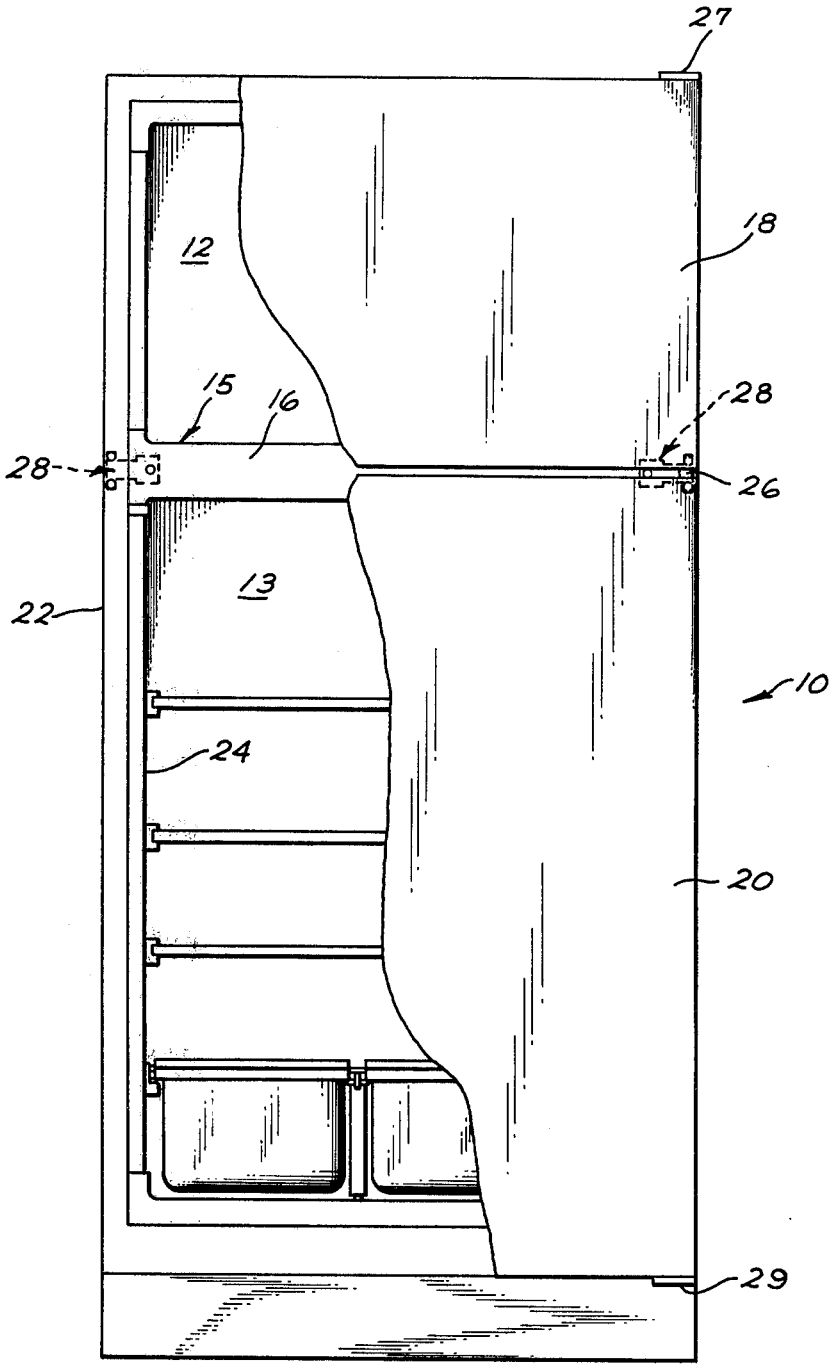
FIG. 1 is front elevational view, partly broken away, of a top mount refrigerator showing both the fresh food compartment below and the freezer compartment above and including the support arrangement of the present invention.
Figure 2:
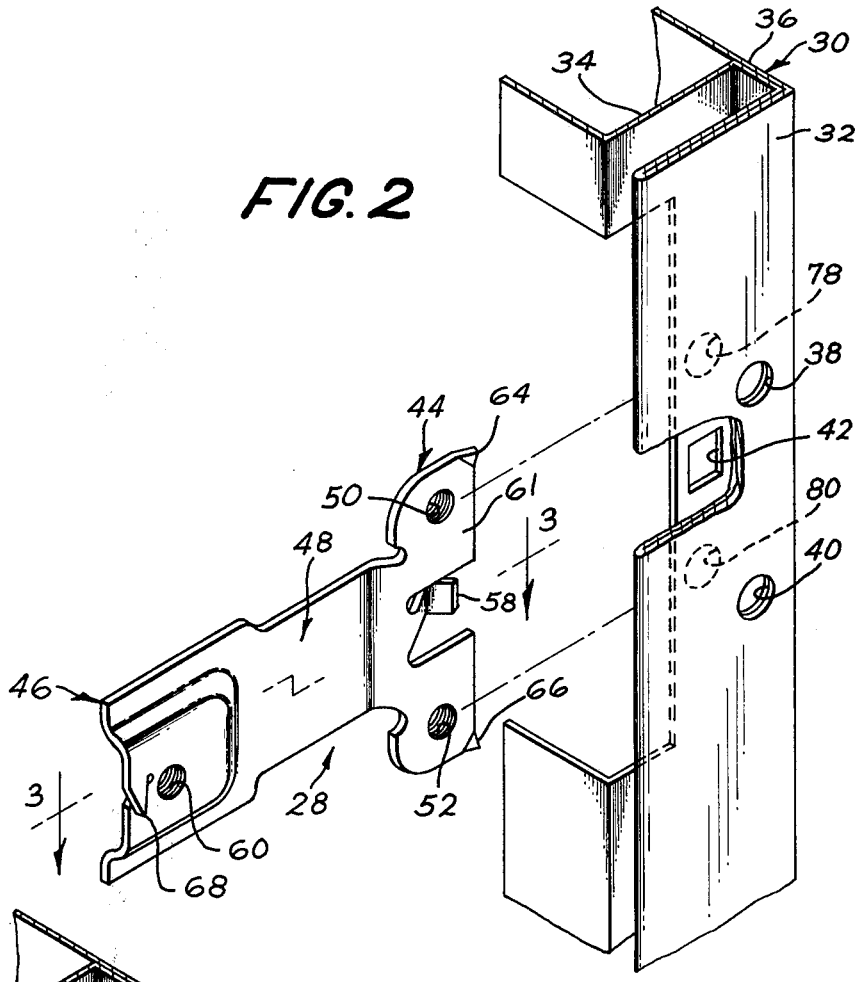
FIG. 2 is a perspective view showing a portion of the cabinet outer case and the cross piece support member prior to the cross piece support member being positioned in the outer case.
Figure 4:
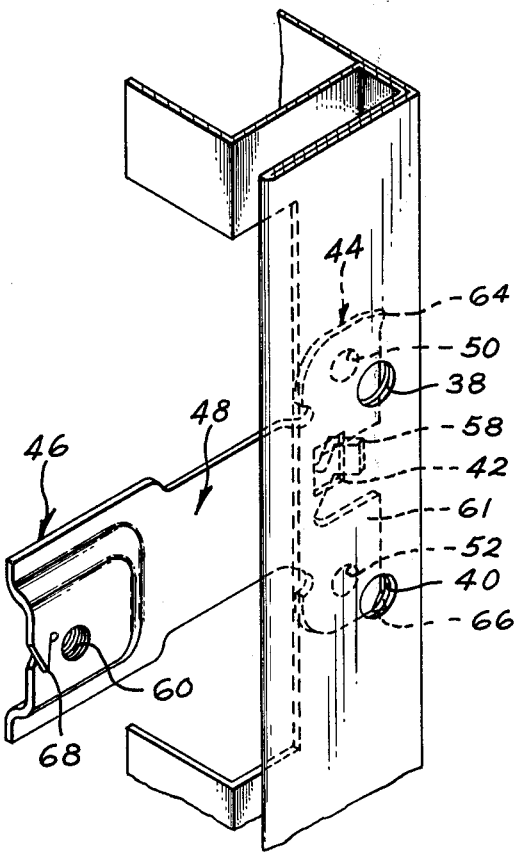
FIG. 4 is the same as FIG. 2 but showing the cross piece support member in its proper position in the outer case.
Figure 5:
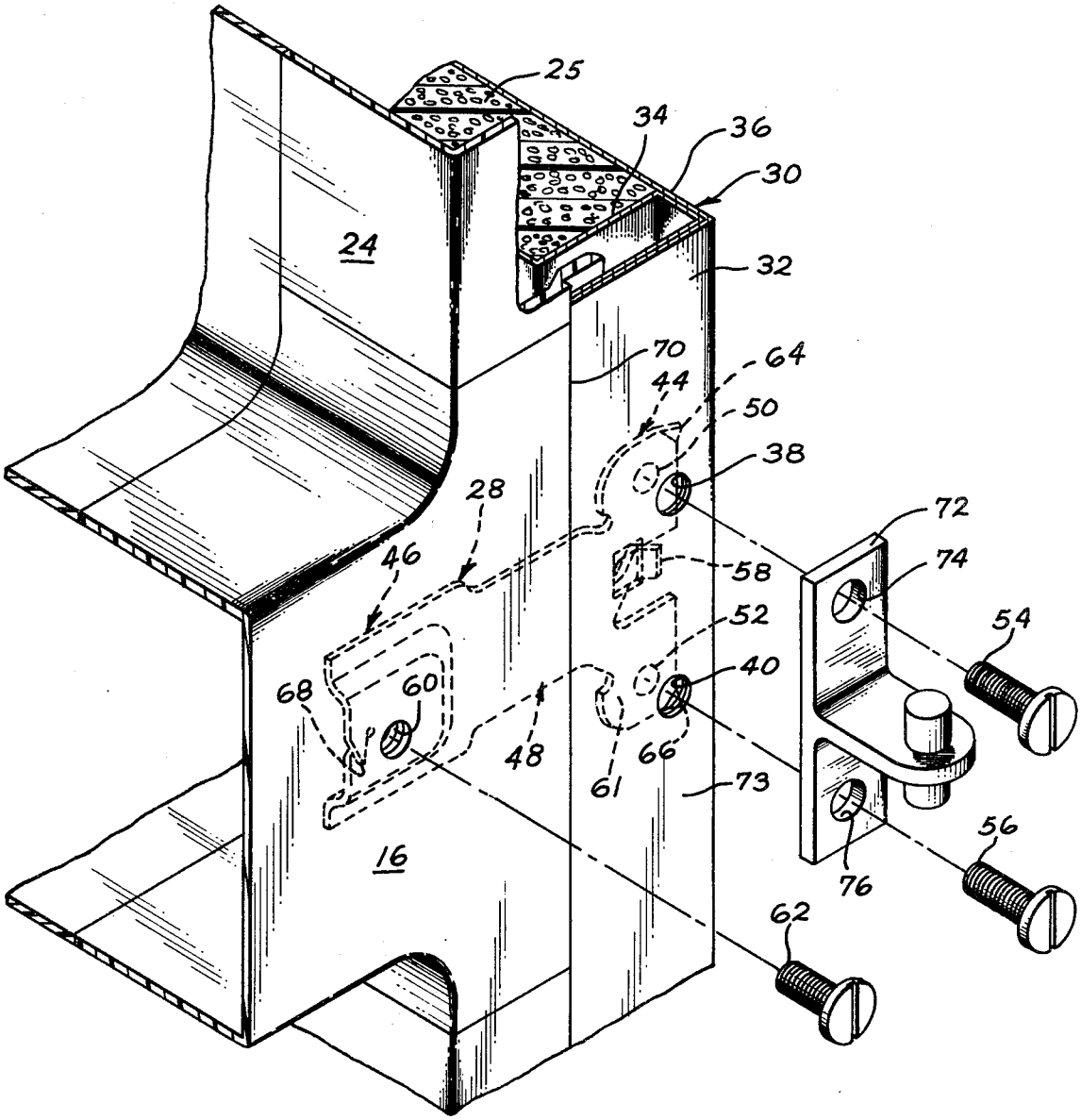
FIG. 5 is an exploded perspective view of the support arrangement of the present invention.

Referring to FIG. 1, a refrigerator 10 such as a top mount household refrigerator, for example, has a freezing compartment 12, and a fresh food compartment 13 separated by an insulated partition 15 having a forwardly positioned mullion 16. The freezer compartment has a door 18 and a fresh food compartment has a door 20 for closing the respective compartments. The refrigerator 10 has a cabinet outer case 22 which envelopes both the freezer and fresh food compartments. The fresh food compartment 13 has an interior liner 24 which is usually made of plastic material. Between the inner liner 24 and the outer case 22 there is insulation 25 (FIG. 5).

One end of both the freezer door 18 and the fresh food door 20 is hingedly supported by the case 22 by means of a hinge pin assembly 26. The other end of each door is hingedly supported by hinge pins 27 and 29 at the top and bottom respectively of the refrigerator. To secure the mullion 16 to the case 22 and the hinge pin assembly 26 to the case 22 there is a cross piece support member generally shown in FIG. 1 as element 28.

With reference particularly to FIGS. 2–5 the details of the support arrangement will now be discussed. The outer case 22 is made from sheet metal and is formed to provide a U-shaped portion 30 which includes an outer leg 32 and an inner leg 34 spaced from the outer leg, both legs of which are connected by a central portion 36. The U-shaped portion 30 is formed by reverse bending the sheet metal to provide a double thickness coextensive with the outer leg 32 and central portion 36 and a single thickness for the inner leg 34. There is thus formed a channel into which will be received the cross piece support member 28. The outer leg 32 is provided with two openings 38 and 40 which are disposed in vertical alignment one with the other and are dimensioned to receive any suitable fastener elements. The inner leg 34 which is of single sheet metal thickness has a slot opening 42 located between the openings 38 and 40 of the outer leg 32, preferably in the middle.

The cross piece support member 28 may be formed from a single sheet of metal and is generally T-shaped. It has a first end 44, a second end 46 and a central portion 48 connecting the first and second ends. The first end 44 has two threaded openings 50 and 52 for receiving therein in threaded engagement fastener elements 54 and 56 as will be explained further below. The first end 44 has a detent tang 58 formed of the sheet material of the cross piece support member 28 and is located between the threaded openings 50 and 52. The detent tang 58 departs from the surface 59 in which the threaded openings 50 and 52 are located and is dimensioned slightly smaller than the slot opening 42 in the inner leg 34 of the U-shaped portion of the outer case. This is to allow the detent tang to be received in the opening 42 when the cross piece support member is being secured to the outer case 22.

The second end 46 of the cross piece support member 28 also has a threaded opening 60 to receive therein a threaded fastener element 62. The cross piece support member has on its first end two raised sharp edges 64 and 66 and the second end has a raised sharp edge 68. The purpose of these raised sharp edges is that during assembly they are to scratch the surface of the sheet metal components, the outer case and mullion respectively, to provide for electrical grounding.

Figure 3:
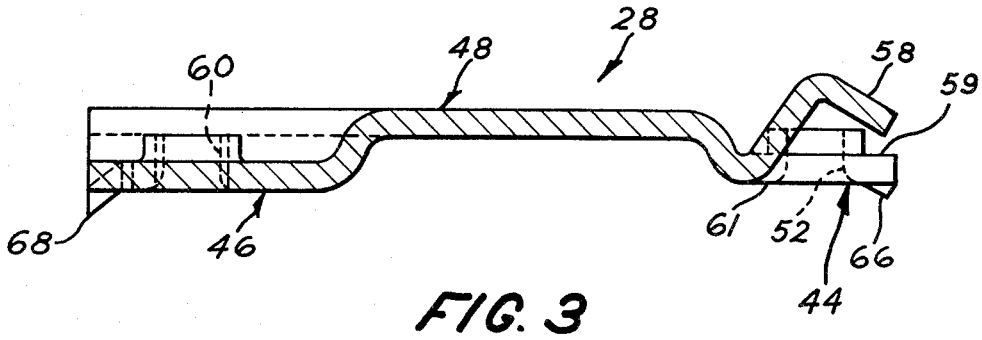
FIG. 3 is a sectional view of the cross piece support member taken along lines 3—3 of FIG. 2.

The assembly of the support arrangement of this invention is accomplished by the cross piece support member 28 having its first end 44 inserted into the U-shaped portion 30 of the outer case 22 such that the detent tang 58 is received in the slot opening 42 and the openings 38 and 40 of the outer leg 32 are in alignment with the threaded openings 50 and 52 of the cross piece support member. The dimensions of the cross piece support member relative to the space between the first and second legs of the U-shaped portion of the outer case are such that the cross piece support member 28 is frictionally held in place with the detent tang 58 inserted in the slot opening 42. That is, the inner leg 34 and outer leg 32 of the U-shaped case portion are spaced from each other a distance slightly less than the distance between the inner most portion of the detent tang 58 and the outer surface of the first end 44 of the cross piece support member 28. The edge of the mullion 16 abuts the edge of the outer leg 32 in the abutting area 70 and is vertically flush one with the other. With reference to FIG. 3, it will be noted that the threaded openings 50 and 52 on the first end of the cross piece member and the threaded opening 60 on the second end lie essentially in the same vertical plane thus allowing the mullion 16 and outer leg 32 of the case to be flush with each other. When the mullion and outer case are in a proper flush abutting position, the fastener element 62 is passed through the opening in the mullion and threadedly engages the threaded opening 60 of the cross piece support member. Thus, the cross piece support member 28 is secured to the mullion 16.

The hinge pin assembly 26 is secured to the outer case by abutting the base 72 of the hinge pin assembly 26 to the outer surface 73 of the outer leg 32 with fastener openings 74 and 76 in horizontal alignment with openings 38 and 40 of the case and also threaded openings 50 and 52 of the cross piece support member. When all of the components are in proper position, then threaded fastener elements 54 and 56 will engage threaded openings 50 and 52 of the cross piece support member 28 and secure the hinge pin assembly 26 to the outer case 22 and also the cross piece support member. To prevent the possibility of interference of the inner leg 34 of the U-shaped portion 30 of the case with the fastener elements 54 and 56, it is preferred that openings 78 and 80 also be provided in the inner leg of the U-shaped portion of the casing which, of course, would be in alignment with the threaded openings 50 and 52 of the cross piece support member.

By the above-described assembly, the mullion 16, the outer case 22, and the hinge pin assembly 26 are all integrally connected by means of a single integrally formed cross piece support member and three fastening elements. The arrangement allows for ease of assembly, is sufficiently rigid to support the hinge pin assembly which in turn supports the hinged doors of both the freezer and fresh food compartments.

The foregoing is a description of the preferred embodiment of the invention and it should be understood that variations may be made thereto without departing from the true spirit of the invention as defined in the appended claims.

What is claimed is:

1. A support arrangement in a refrigerator having a hinged door to attach a hinge pin assembly to the outer case and to secure the outer case to a mullion comprising;
   (a) the case having a U-shaped portion including an outer leg and an inner leg spaced from the outer leg and a center portion joining the two legs, the outer leg having two spaced openings and the inner leg having a slot between the outer leg openings,
   (b) the mullion having an edge abutting the edge of the outer leg of the case and an opening,
   (c) a cross piece support member spanning an area of the mullion and outer case abutment and inserted in the U-shaped portion of the outer case, said cross piece support member having,
      (i) a first end with two spaced openings aligned with the two spaced openings in the outer leg and a detent tang dimensioned and located to snap into the inner leg slot to thereby retain the cross piece support member in its proper position relative to the openings,
      (ii) a second end having an opening in alignment with the mullion opening and a fastener element through both openings to secure the cross piece support member to the mullion, and
      (iii) a central portion connecting the first and second ends,
   (d) a hinge pin assembly abutting the outer case, and
   (e) fastener elements for securing the hinge pin assembly, case and cross piece support member together passing through the two openings in the outer leg of the case and into the openings of the first end of the cross piece support member.

2. The support arrangement of claim 1 wherein there are two openings in the inner leg of the U-shaped portion to receive the fastener elements therethrough.

3. The support arrangement of claim 1 wherein the cross piece support member openings are threaded and the fastener elements are threadedly engaged therewith.

4. The support arrangement of claim 1 wherein the first and second ends of the cross piece support member have raised sharp edges.

5. The support arrangement of claim 1 wherein the slot in the inner leg is in the middle between the two openings.

6. The support arrangement of claim 1 wherein the inner leg and outer leg of the U-shaped case portion are spaced from each other a distance slightly less than the distance between the innermost portion of the detent tang and the outer surface of the first end of the cross piece support member to allow frictional engagement therebetween.

7. The support arrangement of claim 1 wherein the cross piece support member is made from a single sheet of metal.

8. The support arrangement of claim 1 wherein the cross piece support member is T-shaped with the first end having one opening spaced vertical to the other opening.

* * * * *